United States Patent [19]

Mánek et al.

[11] Patent Number: 4,969,550

[45] Date of Patent: Nov. 13, 1990

[54] DEVICE FOR SUPPLYING TEXTILE TUBES FOR A TEXTILE MACHINE

[75] Inventors: Ales Mánek; Zbynek Venci, both of Ûstí nad Orlicí , Czechoslovakia

[73] Assignee: Elitex Liberec, Czechoslovakia

[21] Appl. No.: 406,706

[22] Filed: Sep. 13, 1989

[30] Foreign Application Priority Data

Sep. 14, 1988 [CS] Czechoslovakia ..... 6135-88

[51] Int. Cl.[5] ..... B65G 37/00

[52] U.S. Cl. ..... 198/370; 198/485.1; 198/476.1

[58] Field of Search ..... 198/365, 370, 470.1, 198/476.1, 465.4, 485.1, 486.1, 487.1, 803.9, 803.12

[56] References Cited

U.S. PATENT DOCUMENTS

| | | | |
|---|---|---|---|
| 2,319,280 | 5/1943 | Widell | 198/803.12 X |
| 3,033,342 | 5/1962 | Kinnicutt, Jr. | 198/486.1 X |
| 3,057,457 | 10/1962 | Johnson | 198/803.12 X |
| 3,537,570 | 11/1970 | Sillars | 198/803.12 X |
| 3,581,891 | 6/1971 | Rysti | 198/370 X |
| 4,202,483 | 5/1980 | Sillars | 198/803.9 X |

FOREIGN PATENT DOCUMENTS

| | | |
|---|---|---|
| AO 233522 | 8/1986 | Czechoslovakia . |
| AO 246547 | 12/1987 | Czechoslovakia . |

*Primary Examiner*—Joseph E. Valenza
*Assistant Examiner*—D. Glenn Dayoan
*Attorney, Agent, or Firm*—Ostrolenk, Faber, Gerb & Soffen

[57] ABSTRACT

A device for supplying textile tubes to the supply cells of a horizontal, trough supply tank situated over the winding units of a textile machine, especially, an open-end spinning machine. The device is mounted on a movable, endless traction carriage and includes front carriers having a backwardly oriented suspension section for temporary support of the front edges of the textile tubes, and rear pushing-type carriers equipped with double-arm, tilting holders with lower ends bent for carrying the rear edges of the textile tubes. A respective sloping control segment is situated over each supply cell for controlling a roller of the double-arm, tilting holder so as to either grip the textile tube between the front and rear carriers or release the rear carrier from the tube which enables insertion of the tube into the supply cell.

9 Claims, 1 Drawing Sheet

DEVICE FOR SUPPLYING TEXTILE TUBES FOR A TEXTILE MACHINE

BACKGROUND OF THE INVENTION

1. Field of the Invention:

The invention relates to a device for supplying textile tubes to supply cells of a horizontal, trough supply tank situated over the winding units of a textile machine, and especially an open-end spinning machine.

2. Description of the Related Art:

The hitherto known devices for supplying tubes to such machines utilize a slide path comprising the upper parts of the surfaces of the textile tubes that are already seated in the supply cells. Tubes are continuously supplied, at intervals depending upon the selected number of the tubes, from an intermediate tank fitted with a dosing device for supplying the textile tubes individually to the empty or free carriers of a traction transporter which moves the tubes forward over the supply cells. Due to the force of gravity, the first textile tube slides into the first supply cell. The upper part or surface of that tube then serves as a slide path for the next textile tube supplied which can slide over the tube already in the supply cell. In a continuous manner, the next textile tube slides over the tops of the tubes in cells and into the next free supply cell, and so on until all supply tanks are full.

Then, a traction transporter continuously supplies a second set of textile tubes to be positioned as a second layer, i.e., in each supply cell a textile tube of this second layer is positioned atop a textile tube already seated in the supply cell. If then, as the need arises, a supply cell has been emptied, the textile tube of the second upper layer enters the respective supply cell due to the force of gravity.

This system of supplying textile tubes to cells can be carried out in practice, however, only during the so called "collective emptying" of the supply cells, i.e., when all the textile tubes seated in all the supply cells are removed one by one.

However, if the supply cells are emptied irregularly, or according to actual need, which can occur repeatedly at the same supply cell, refilling of the supply cells have been carried out so that a traction means permanently circulates to transport the second layer of the textile tubes. Any textile tube of this layer can then enter any empty supply cell, and the respective free carrier of the traction transporter receives another tube from the dosing device.

This system, however, is unsatisfactory when the emptying of a supply cell and its refilling takes place simultaneously.

SUMMARY OF THE INVENTION

Accordingly, it is an object of the present invention to overcome the above-mentioned problems in the known systems such that textile tubes may be supplied to the supply cells regardless of the emptying of the supply cells and the supply cells may be refilled continuously after exchanging the textile tubes.

This object and others are achieved by providing an apparatus including rear carriers fitted with double-arm tilting holders having bent ends for carrying the rear or trailing edges of the textile tubes. Each such holder has an upper control arm that is fitted with a roller. In the forward motion path of those rollers are situated sloping control segments, one over each supply cell for a textile tube. The front part of the textile tube transported is lifted upward with respect to the direction of its motion so as to avoid colliding with the textile tube which is at that moment being taken out of the respective supply cell by rolling up and over the front edge of this supply cell. The transported tube is securely transported from the upper layer of tubes to the lower layer and once it moves into the lower layer, it there assumes the required, exactly defined position which is necessary for the subsequent operation, i.e., for its removal out of the supply cell. Thus, it is necessary to ensure that its rear part can fall into the lower layer of tubes only at an exactly defined point within very narrow tolerances of its path. This is provided for by the double-arm, tilting holder which extends into the hollow space inside the rear part of the textile tube.

Other features and objects of the invention will become apparent from the following detailed description of a preferred embodiment of the invention is considered in conjunction with the accompanying drawings.

BRIEF DESCRIPTION OF THE DRAWINGS

An embodiment of the device according to this invention is shown by way of example in the accompanying drawings.

DETAILED DESCRIPTION OF THE PREFERRED EMBODIMENTS

Figure 1:
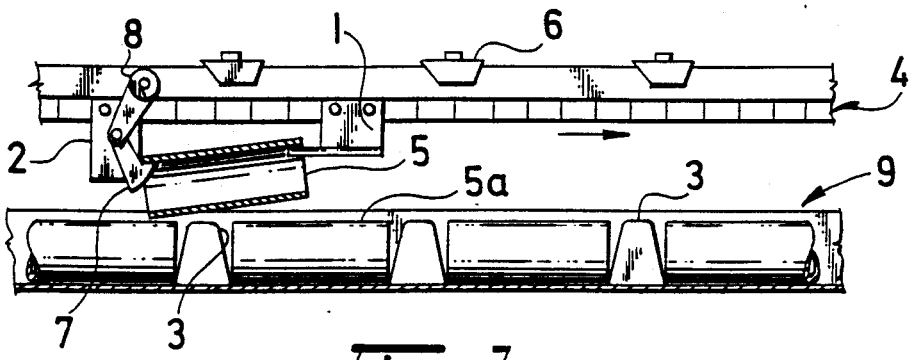
FIG. 1 is a longitudinal sectional view of a tube being carried by carriers of an endless, traction means in accordance with the invention.
Figure 2:
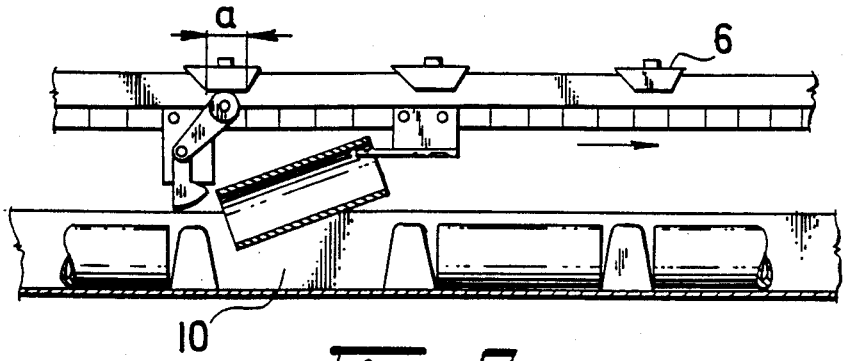
FIG. 2 is a longitudinal, sectional view showing insertion of a textile tube into a supply cell of a trough supply tank by means of a double-arm, tilting holder of the invention.
Figure 3:
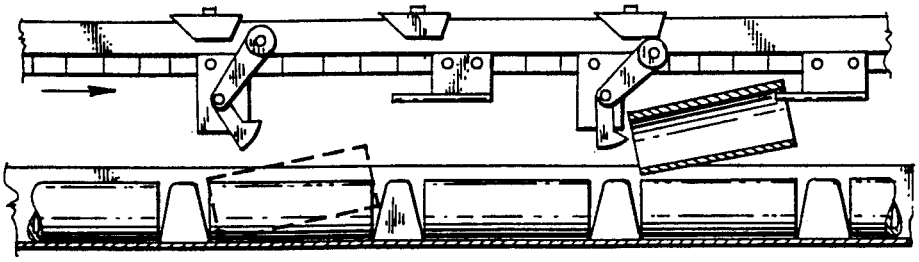
FIG. 3 is a longitudinal, sectional view of the trough supply tank with the textile tube inserted therein.

Referring now to FIGS. 1, 2 and 3, the device is comprised of a horizontal trough supply tank 9 which is divided into supply cells 10 by means of transverse partitions 3. Each partition has a base that is wider than its top portion. A transported textile tube 5, moving in a region usually occupied by the upper layer of such tubes during their transport, has a front part that is lifted by means of a carrier 1 and has a rear part that is pushed by a rear carrier 2. The two carriers are part of an endless moving traction means 4. The rear carrier 2 is a double-arm, tilting holder 7 whose control arm carries a roller 8 and whose lower arm includes means which enter the rear of the tube being transported. As seen in a comparison of FIGS. 1 and 3 with FIG. 2, the holder 7 of the carrier 2 pivots on the carrier between its below described positions under the influence of the control segment 6, pivoting clockwise to release the tube 5 and counterclockwise to engage and support the tube.

At the moment, shown in FIG. 2, when the double-arm, tilting holder 7 is displaced out of the interior of the textile tube 5 due to the camming action of the sloping control segment 6 situated over each supply cell 10, the rear part of the textile tube 5 falls to the bottom of the supply cell 10. The textile tube 5 is thereafter not being pushed by the rear carrier 2 and the tube is stopped from further forward motion by friction with the bottom and walls of the supply cell 10. However, the carrier which lifted the front part of the textile tube 5 keeps moving forwardly, because it is part of the endless moving traction means 4. Thus, the carrier 1 is released from engagement with the front part of the then non-moving textile tube 5, which then falls by force of gravity into the supply cell 10.

If the supply cell 10 in question is not empty but instead is filled with a textile tube 5 which is at the lower layer, the double-arm, tilting holder 7 of the endless moving traction means 4 still goes through a path a and leaves the rear of the tube, as before. But the tube in the then full cell does not permit the rear of the tube to fall into the cell. At the end of the path a, the tilting holder 7 is moved by means of its roller 8, rolling forward off the sloping control segment 6, to reenter the rear part of the textile tube 5 which had not moved to the lower layer, as shown in FIG. 3.

Figure 4:
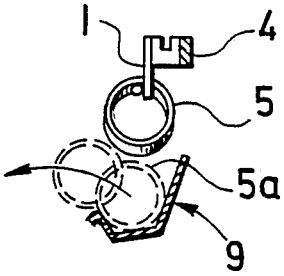
FIG. 4 is a transverse view of the device according to the invention.

FIG. 4 shows the upraised front edge of the upper textile tube 5, which is to be inserted into the supply cell 10, in relation to the path allowed by the outer circumference of a textile tube 5*a* being taken out of this supply cell 10. It will be understood that since the front part of tube 5 is lifted with respect to its rear part, the simultaneous removal of tube 5*a* from the cell and insertion of tube 5 into the cell can be achieved.

The supply and insertion of the other textile tubes is carried out in the same manner.

Although the present invention has been described in relation to a particular embodiment thereof, many other variations, modifications, and other uses will become apparent to those skilled in the art. It is preferred, therefore, that the present invention be limited not by the specific disclosure herein, but only by the appended claims.

We claim:

1. A device for supplying textile tubes to the supply cells of a trough supply tank, the device comprising:

a traction device disposed over the trough supply tank;

for each textile tube that is to be carried by the traction device, a respective front carrier supported on the traction device for releasably suspending the front edge of a textile tube, and a respective rear carrier supported on the traction device and spaced rearwardly of the front carrier and including means for releasably suspending a rear edge of the textile tube whose front edge is supported by the front carrier; the rear carrier being movable between a first position at which the rear carrier is able to support and suspend the rear edge of the textile tube and a second position at which the rear carrier is free of supporting the rear edge of the textile tube;

the traction device including moving means for moving the supported front and rear carriers forwardly over the trough supply tank;

a control segment supported nonmovably at the traction device over the trough supply tank, the traction device moving means moving the carriers past the control segment;

the rear carrier including engaging means for engaging the control segment as the rear carrier is moved along the traction device by the moving means, and the engaging means and the control segment being respectively so shaped that upon engagement of the engaging means with the control segment as the rear carrier is moving past the control segment, the rear carrier is moved out of the first position for suspending the rear edge of the textile tube and moves into the second position, freeing the rear edge of the textile tube to fall toward the trough supply tank, and the control segment being shaped such that when the rear carrier has moved past the control segment and the engaging means of the rear carrier moves past the control segment, the rear carrier returns to the first position at which it can engage and suspend the rear edge of a textile tube then being supported by the respective front carrier;

whereby when no textile tube is present in the trough supply tank where the rear edge of the textile tube has fallen toward the tank after the rear carrier has moved to its position, the rear edge of the textile tube is restrained by the trough supply tank from moving along with the moving means and the textile tube is thereby dragged off the front carrier to fall into the trough supply tank and below the front and rear carriers, and the front and rear carriers being of a height toward the trough supply tank that the front and rear carriers pass over a textile tube in the trough supply tank; and when a textile tube is already in the trough supply tank after the rear carrier has moved to its second position, the textile tube already in the trough supply tank preventing the rear edge of the textile tube that had been supported on the rear carrier from falling into the trough supply tank and the rear carrier being of a height toward the trough supply tank that the rear carrier blocks the rear edge of the textile tube from being dragged off the front carrier on the textile tube that is then in the trough supply tank and continues to engage the rear edge of the textile tube until the rear carrier returns to the first position.

2. The device of claim 1, wherein the trough supply tank is disposed beneath the traction device and beneath the carriers, the trough supply tank having a plurality of sections defined therein, each section for receiving a textile tube, and the sections being arranged along the path of the moving means of the traction device; a respective control segment being defined on the traction device adjacent each of the sections of the trough supply tank, such that each of the rear carriers being moved along the trough supply tank by the moving means is caused to move to the second position and release its support of the rear edge of the textile tube at each of the sections of the trough supply tank.

3. The device of claim 1, wherein the rear carrier is swingable in its orientation from the first position at which it suspends the rear edge of the textile tube to its second position at which it releases the support of the rear edge of the textile tube, and the engagement between the engaging means of the rear carrier and the control segment, through the respective shaping of the engaging means and the control segment, causing the rear carrier to move from the first to the second position.

4. The device of claim 3, wherein the control segment includes a surface which directs the engaging means of the rear carrier to move in the direction toward the trough supply tank, and the rear carrier being so supported to the traction device that upon movement of the engaging means toward the trough supply tank, the rear carrier moves to the second position.

5. The device of claim 4, wherein the rear carrier comprises a double arm unit pivotally supported to the moving means of the traction device, the double arm unit including an upper arm having the engaging means thereon for engaging the control segment, such that engagement between the engaging means and the control segment pivots the upper arm, and including a lower arm attached to and movable with the upper arm, and the lower arm including means thereon on which the rear edge of the textile tube is supported when the rear carrier and the lower arm thereof are in the first supporting position.

6. The device of claim 5, wherein the engaging means on the upper arm comprises a roller for rolling over the control segment.

7. The device of claim 5, wherein the trough supply tank is disposed beneath the traction device and beneath the carriers, the trough supply tank having a plurality of sections defined therein, each section for receiving a textile tube, and the sections being arranged along the path of the moving means of the traction device; a respective control segment being defined on the traction device adjacent each of the sections of the trough supply tank, such that each of the rear carriers being moved along the trough supply tank by the moving means is caused to move to the second position and release its support of the rear edge of the textile tube at each of the sections of the trough supply tank.

8. The device of claim 3, wherein the front carrier comprises a backwardly oriented suspension section, extending to support and suspend the front edge of the tube therefrom.

9. The device of claim 1, wherein the front carrier comprises a backwardly oriented suspension section, extending to support and suspend the front edge of the tube therefrom.

* * * * *